United States Patent [19]

Asselbergs

[11] Patent Number: 4,846,399

[45] Date of Patent: Jul. 11, 1989

[54] FAN DEVICE

[75] Inventor: Christophe K. J. Asselbergs, Calgary, Canada

[73] Assignee: Suncourt Holdings Inc., Calgary, Canada

[21] Appl. No.: 252,521

[22] Filed: Oct. 3, 1988

[51] Int. Cl.[4] ..... F24F 7/06

[52] U.S. Cl. ..... 236/49.4; 98/103; 415/207

[58] Field of Search ..... 236/49 D; 98/103, 39.1, 98/42.02, 42.07, 42.11, 101, 108; 415/121 G, 207

[56] References Cited

U.S. PATENT DOCUMENTS

| | | | |
|---|---|---|---|
| 1,645,140 | 10/1927 | Herbruck | 98/103 X |
| 2,561,592 | 7/1951 | Palmer | 98/39.1 X |
| 4,048,911 | 9/1977 | Petersen | 98/39.1 X |
| 4,123,968 | 11/1978 | Malott | 98/42.02 X |
| 4,261,255 | 4/1981 | Anderson et al. | 98/42.02 |
| 4,576,331 | 3/1986 | Harwell | 98/103 X |
| 4,722,266 | 2/1988 | Deckert | 98/103 |
| 4,754,697 | 7/1988 | Asselbergs | 236/49 D X |

*Primary Examiner*—William E. Tapolcai

*Attorney, Agent, or Firm*—Beveridge, DeGrandi & Weilacher

[57] ABSTRACT

A readily portable fan device which is usable both as a cooling fan for circulating ambient air and as a device for increasing the flow of air through a register, comprises a housing containing both a fan impeller and an electric motor for driving the impeller, the housing having a skirt surrounding a bottom air inlet and capable of at least partially sealing a space around such register, the fan directing air upwardly through an outlet aperture when resting on the skirt. The device has another floor engaging surface perpendicular to the plane of the skirt on which the device may rest with its air inlet open to the ambient air. The impeller blades and the outlet aperture are specially designed to maximize air throughput.

8 Claims, 2 Drawing Sheets

FAN DEVICE

The present invention relates to a fan for use in domestic hot air heating and for cooling.

It has previously been proposed to increase the efficiency of forced air heating systems by use of a fan placed against a wall or floor register to boost the flow of air through the register. A thermostatic control may be provided so that the fan only operates when hot air is being delivered to the register. Most of the prior art proposals require more or less complicated installation and wiring of the device, and do not allow the device to be used as a fan for circulating ambient air within a room.

The present invention provides a readily portable fan device usable either as a cooling fan for circulating ambient air within a room, or as a device for increasing the flow of air through a register, normally a floor register, which may be cool air or heated air depending on requirements. The device requires no special installation.

Some prior art devices intended for boosting air flow through registers are not notably efficient. For example, tests conducted on the device described in U.S. Pat. No. 4,576,331 (issued Mar. 18, 1986 to Harwell) showed that, when used with registers already provided with reasonably good airflow, the device restricted rather than boosted the flow. Other designs for such devices show little consideration for the efficiency of the device, the direction of air discharge, and avoidance of noise. The present invention is the result of careful research into types of fan blade and the best arrangement of fan casing to produce a device which moves useful quantities of air while using little power and producing little noise.

Certain features of this invention are described in my prior U.S. patent application Ser. No. 940,664 filed Dec. 11, 1986 now U.S. Pat. No. 4,809,593. These include a housing containing both a fan impeller and an electric motor for driving the impeller, the housing having a skirt surrounding a bottom air inlet and capable of at least is arranged to direct air generally upwardly through an outlet in the housing when the device is resting on the skirt. The device has a further floor engaging surface generally perpendicular to the plane of the skirt edges and on which the device may alternatively rest, with the air inlet open to the ambient air, when used as a cooling fan.

In accordance with the present invention, the housing has a peripheral wall and a top wall joined to said peripheral wall, the air outlet being provided by a generally central outlet aperture in the top wall and overlying the impeller, the peripheral wall including two sidewalls joined by endwalls, central portions at least of said sidewalls being generally flat. Unlike in my prior design, the spaces between the sidewalls and the impeller are free of any ducts or vane means so that air A special feature of this fan device is that the outlet aperture is non-circular, and more specifically is defined in part by side edges extending between the central portions of the sidewalls, these edges lying outside a circular area which corresponds to the perpendicular projection of the impeller circumference on the top wall. The side edges are curved around this circular area but deviate from a circular shape sufficiently to provide discrete enlargements of the aperture lying outside the circular area and adjacent to the sidewalls.

Preferably four such enlargements are provided at the junctions of the curved edges with the sidewalls. This arrangement allows least obstruction to the flow of air leaving the fan blades.

A further special feature of this invention is that the fan impeller, which is generally of the propeller or axial flow type, has blades which increase in width with increasing radius; with such an arrangement most of the air movement is performed by the outer blade parts which are moving fastest. A fan of this kind produces a significant swirling motion of the air caused by a centrifugal effect of the fan blades. Such a fan not only produces good air flow but distributes this well around a room when used with a register boosting device. In order for such a fan to work effectively, the aperture outlet must be sufficiently close to the impeller that substantially all the air leaving the fan blades passes out of the aperture rather than being trapped under the top wall. In accordance with this feature of the invention, the impeller blades have tips which are sufficiently close to the aperture that air expelled from the parts of these tips closest to the aperture in a largely radial direction at 35° to the impeller plane passes substantially entirely outwardly through the aperture. Preferably, the blade tips are within 1 cm of the plane of the aperture.

Preferably also, the curved edges of the aperture are closest to said circular area at points midway between the sidewalls and depart progressively from said circular area with increasing distance from said midway points until said curved edges meet substantially straight ends of said aperture which are parallel to and adjacent the said flat central portions of said sidewalls, four of said enlargements accordingly being provided at the junctions of the curved edges and straight ends.

The invention will further be described with reference to the accompanying drawings, showing a preferred embodiment, and in which.

Figure 6:
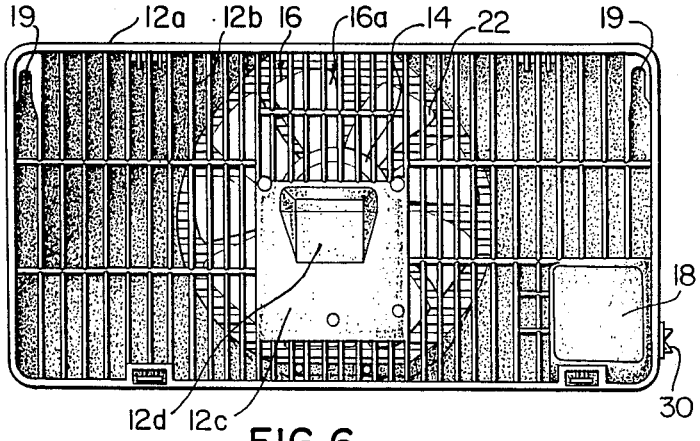
FIG. 6 is an underside view of the device.

The main parts of the fan device are a top housing 10, a base part 12, a fan motor 14 mounted on the base part the shaft of which carries a fan impeller 16; and electrical switches and control means located on a fan control mount indicated at 18 in FIG. 6. The major parts 10 and 12 are both integrally molded of plastics material, and these parts have co-operating latching elements which allow the major parts to be snapped together for easy assembly, no screws or like holding means being required.

The housing 10 is generally rectangular and has substantially vertical front and rear walls 10*a* and 10*b*, and has trapezoidal end walls 10*c* which allow the front wall of the device to be lower than the rear wall. A centrally apertured top wall 10*d* slopes down from the rear wall to the front wall for a purpose to be described. The base part 12 includes a thickened skirt 12*a*, and a series of cross-ribs 12*b* providing a rectangular grid of openings which occupy the majority of its surface to allow relatively unrestricted airflow therethrough. The only substantial restrictions to air flow are a motor mounting panel 12*c* close to the centre of the base part, and the fan control mount 18. The skirt 12*a* is sized to fit and form a substantial seal around a typical floor register used as an outlet for heated air in domestic heating systems; typical external dimensions are 30 cm×16 cm. In order that the device can also be used with a wall register, two screw-head retaining slots 19 are provided in the base part so that the device can be hung from two screws inserted into a wall close to the top of the register.

Figure 5:
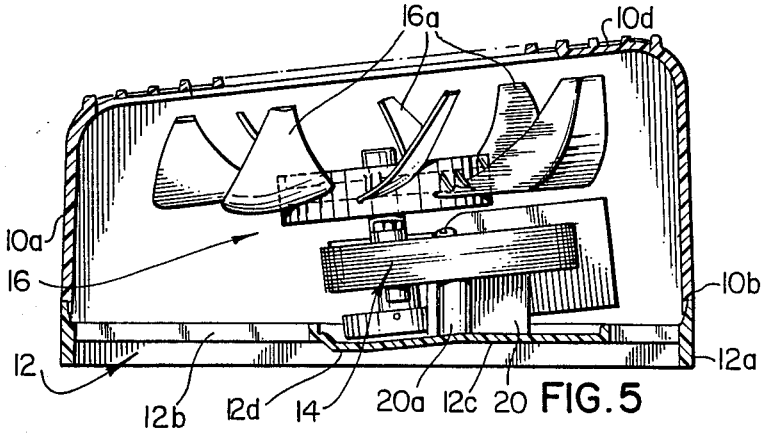
FIG. 5 is a cross-sectional view of the device on lines 5—5 of FIG. 3.

The motor mounting panel 12*c* carries upwardly projecting lugs 20 shown in FIG. 5, each of which has a screw receiving part 20*a* engaging with mounting means on the motor 14. The tops of lugs 20 slope so as to be parallel to top wall 10*d;* the panel 12*c* includes a downwardly recessed part 12*d* which accommodates the lowest part of the motor. The motor is mounted closer to the rear wall than to the front wall, but the motor shaft is eccentric relative to the motor axis and is substantially centrally positioned in the housing 10.

The motor shaft carries a central hub 16*a* of the impeller 16, from which project nine blades 16*b* which are integrally molded with the hub. The fan blades are of swept back design having a convex leading edge and a concave trailing edge, and the blades increase in width with increasing radius while having an upwardly concave airfoil type curvature. The result of these curvatures is to provide upwardly curving, extended trailing tip portions 22 which move the air not only axially but with a large radial component, i.e. the fan operates both as an axial flow fan and as a centrifugal fan. With a suitable design of aperture located near to the plane of the blade tip extremities so as not to obstruct unduly the radial component of airflow, such a fan gives good distribution of air both along the fan axis and to the sides of such axis.

Figure 1:
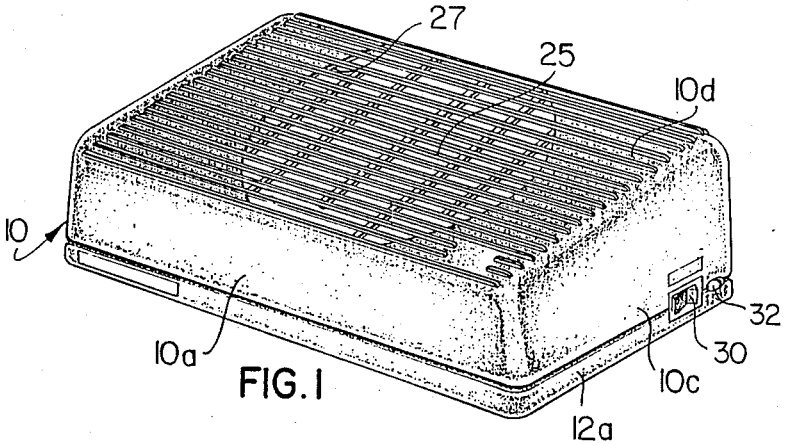
FIG. 1 is a perspective view of the fan device.
Figure 2:
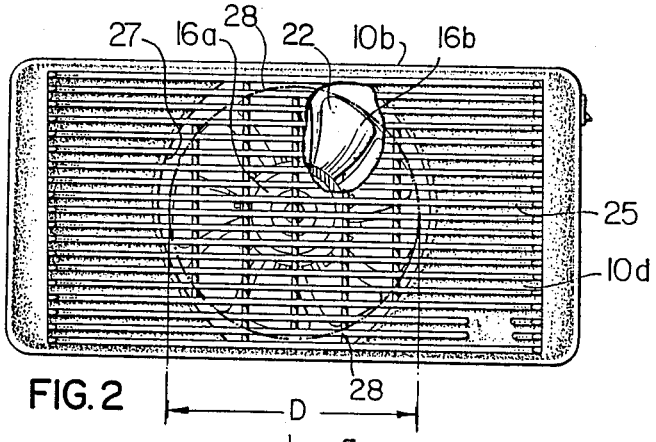
FIG. 2 is a plan view of the device.
Figure 3:
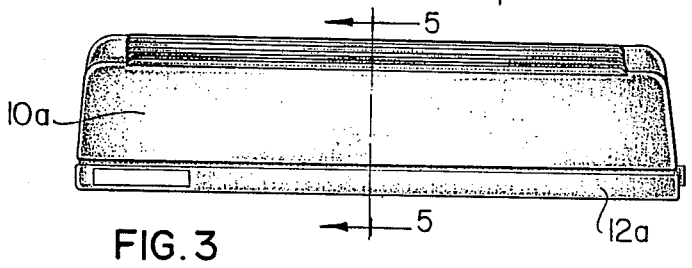
FIG. 3 is a front side view of the device.
Figure 4:
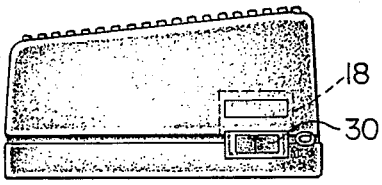
FIG. 4 is an end view of the device.

The suitable design of aperture will now be described with reference to FIG. 2. As shown, the main side portions of the top wall 10*d* are imperforate and have reinforcing ribs 25 which continue as part of a grill over a central aperture defined by side edges 27. These side edges 27 are outside of, and are curved around, a circular area indicated as A in FIG. 2 which area corresponds to the perpendicular projection of the impeller circumference onto the top wall. The edges 27 are part circular but have centres of curvature off-set from each side of the centre of area A, so that the edges are closest to area A at points midway between the sidewalls and depart progressively from circular area A they meet straight ends 28 of the aperture which are parallel to and close to the flat side walls 10*a* and 10*b*. This arrangement provides for discrete enlargements of the aperture, as compared to a circular aperture surrounding the area A and having a diameter D equivalent to the smallest width of the aperture. These enlargements allow air which would otherwise be trapped to escape relatively freely.

The advantages of having an aperture shape with enlargements as described has been demonstrated by tests comparing the air throughput for this arrangement with that given by a circular aperture of diameter D. When used with a register having a basic (non-boosted) air velocity of 300 fpm (1.5 m/sec), with a fan impeller of the type described, circular apertures having a diameter of $\frac{1}{4}$ inch to $\frac{3}{4}$ inch (0.6 cm to 1.9 cm) larger than the impeller diameter ($5\frac{1}{4}$ inch or 13.3 cm) gave increases in air velocity of less than 10%. When the same impeller and register were used with apertures shaped as described, increases in air velocity up to 50% were achieved; the latter was obtained with an aperture having dimension "D" $\frac{1}{3}$ inch (0.85 cm) larger than the impeller diameter. An increase of 40% was achieved with a similarly shaped aperture having a dimension "D" $\frac{1}{4}$ inch (0.6 cm) larger than the impeller diameter. Generally, it was concluded from these tests that the aperture should have a dimension "D" between $\frac{1}{4}$ inch to $\frac{1}{2}$ inch (or about 0.6 to 1.2 cm) larger than the impeller diameter.

The aperture size is also related to the clearance space between the impeller blades and the top wall. This clearance is preferably such that substantially all the air expelled by the impeller with a large radial component passes out of the aperture and does not become trapped under the top wall. The angle at which air leaves the blades is between 15° and 35° to the plane of the impeller, so that the maximum clearance is such that air leaving the corner tips of the blades closest to the outlet aperture at 35° passes substantially entirely out of the aperture. More preferably, the clearance is such that this occurs with an angle of 20°. A preferred clearance space is 0.8 cm; the clearance space should in all cases be less than 1.0 cm and a preferred range is between about 0.4 to 0.8 cm.

The motor 14 is connected, by cables not shown, in circuit with a thermostat also not shown connected in series with a control switch 30 all mounted on control mount 18; these items being connected to a cable passing out of aperture 32. The thermostat may be a snap-disc, bi-metallic, or solid state. device. such devices being readily available; this is exposed to air entering the air inlet. The circuit for the motor may also include a timer and/or means for varying the speed of the motor.

When being used to supply additional heat from a forced air domestic heating system, the device is placed with its skirt surrounding a floor register the thermostat is set at say 35°C., and the control switch is set so that the fan is activated automatically at this temperature. Thus, when the thermostat senses that heat is being supplied to the register. the fan becomes operative. The fan not only increases the flow of air through the register. but since the air is flowing faster through the duct system it enters the room at a higher temperature. The device also continues to draw heat from the furnace heat exchanger for a few minutes after the furnace fan has shut down, thus increasing the efficiency of the furnace. If the device has a timer, this can be arranged to supply extra heat only during certain hours.

The device can also be used to increase the cooling effect of a central air conditioning system. In this case, the thermostat is adjusted to close when this senses cooled air being delivered through the register.

A preferred form of the device has a thermostatic switch in circuit with the motor and arranged to energize the motor both when the air temperature sensed is above a certain limit ($T_1$), and when the temperature sensed is below a lower limit ($T_2$). $T_1$ thus represents the conditions appropriate for a heating system, while $T_2$ is chosen to respond to air temperature of an air conditioning system.

Additionally, the device can be used for cooling even where no air conditioning system is used. Firstly, with the device placed over a register, the fan can be operated continuously or intermittently to draw cool basement air through the register and into the room. Alternatively, the device can be placed to rest on the rear sidewall 10*b* so that the air inlet of the fan is open to the ambient air. The device then operates as an ordinary personal fan, and for example may be placed on a counter top. Due to the slope of the top wall and of the fan mount, the direction of air flow will have a slight upward component when working in this position. It will be seen that in this position the main mass of the motor will be below the vertical centre of the device, due to the off-set arrangement of the motor spindle, ensuring adequate stability.

The fan device may also be used with a vertical wall register, either by being placed upright, as described, close to the register, or by being suspended from screws placed at the upper corners of the register, the screw heads being engaged by slots 19.

The fan motor is designed to run at close to a constant speed. The motor has a free shaft speed, without the impeller, of 3600 r.p.m. With the impeller installed, and placed inside the housing, the motor runs at 2150 r.p.m. when in free air, i.e. not placed on a register or on an obstruction. The motor is also designed, by adjustment of stator-to-rotor slip and magnetic flux field, that the torque produced drops off sharply at any motor shaft speed over 2200 r.p.m. Under normal conditions, i.e. over an average register, the fan will run at approximately 2100 r.p.m. and produce 2.14 inch-ounce of torque. At higher r.p.m., the torque drops off rapidly. The impeller characteristics are such as to produce a fan speed of between 2000 and 2300 r.p.m. High speeds would be noisy depending on whether the device has a free flow of air into the intake (as in a personal fan) or whether the device is receiving air from a register. and may cause the fan to activate. Thus, the fan normally operates at a maximum speed within about 15% of the minimum speed.

I claim:

1. A fan device usable for increasing the flow of air through a register, comprising a housing containing both a fan impeller and an electric motor for driving the impeller, said housing having a skirt surrounding an air inlet and having edges capable of at least partially sealing a space around said register, the impeller being arranged to direct air generally upwardly through a top outlet in the casing when the device is resting on said skirt;

said housing having a peripheral wall and a top wall joined to said peripheral wall, said top outlet being provided by a generally central aperture in said top wall overlying the impeller, said peripheral wall including two sidewalls joined by endwalls, central portions at least of said sidewalls being generally flat; the spaces between said sidewalls and said impeller being free of any ducts or vane means so that air can move freely across said spaces;

wherein said outlet aperture is defined in part by side edges extending between the central portions of the sidewalls, said edges lying outside a circular area which corresponds to the perpendicular projection of the impeller circumference on the top wall, said side edges being curved around said circular area but deviating from the circular area sufficiently to provide discrete enlargements of said aperture lying outside said circular area and adjacent the sidewalls;

wherein said fan impeller has blades which increase in width with increasing radius, the blades having tips which are sufficiently close to the aperture that air expelled from the corners of the impeller tips closest to the aperture in a largely radial direction at 35° to the impeller plane passes substantially entirely outwardly through the aperture.

2. A fan device according to claim 1, wherein the curved edges of the aperture are separated by a minimum dimension, as measured across the centre of the aperture, which is between 0.5 cm and 1.5 cm larger than the maximum impeller diameter.

3. A fan device according to claim 1, wherein the said curved edges of the aperture are closest to said circular area at points midway between said sidewalls and depart progressively from said circular area with increasing distance from said midway points until said curved edges meet substantially straight ends of said aperture which are parallel to and adjacent the said flat central portions of said sidewalls, four of said enlargements accordingly being provided at the junctions of the curved edges and straight ends.

4. A fan device according to any of claims 1 to 3, wherein the impeller blades have tips which are within 1 cm of the plane of the aperture.

5. A fan device according to any of claims 1 to 3, wherein air expelled in a largely radial direction from the corners of the impeller tips closest to the aperture at 20° to the impeller plane passes substantially entirely outwardly through the aperture.

6. A fan device according to claim 1 wherein one of said sidewalls is substantially perpendicular to the plane of the skirt and higher than the other sidewall so that the plane of the top wall is non-parallel to the skirt plane, the axis of the impeller being perpendicular to the plane of the top wall, whereby the device can be used with said one sidewall resting on a horizontal surface and with air from the impeller being directed partially upwardly from the horizontal surface.

7. A fan device according to claim 6, wherein the axis of the motor is off-set from the impeller axis towards said one sidewall.

8. A device according to any of claims 1–3, wherein said electric motor is in circuit with a thermostatic switch exposed to air entering said air inlet and arranged to energize said motor both when an air temperature above a certain limit ($T_1$) is sensed and when a temperature below a certain limit ($T_2$) is sensed, where $T_1$ is a higher temperature than $T_2$.

* * * * *